US008465020B2

(12) United States Patent
Dai et al.

(10) Patent No.: US 8,465,020 B2
(45) Date of Patent: Jun. 18, 2013

(54) AUDIBLE PUZZLE CUBE

(75) Inventors: Peng Dai, Heilongjiang (CN); Hailong Wang, Heilongjiang (CN)

(73) Assignee: Empire Technology Development LLC, Wilmington, DE (US)

( * ) Notice: Subject to any disclaimer, the term of this patent is extended or adjusted under 35 U.S.C. 154(b) by 0 days.

(21) Appl. No.: 13/263,841

(22) PCT Filed: Oct. 28, 2010

(86) PCT No.: PCT/CN2010/078182
§ 371 (c)(1),
(2), (4) Date: Oct. 11, 2011

(87) PCT Pub. No.: WO2012/055103
PCT Pub. Date: May 3, 2012

(65) Prior Publication Data

US 2012/0184341 A1 Jul. 19, 2012

(51) Int. Cl.
*A63F 9/06* (2006.01)
*A63F 9/24* (2006.01)

(52) U.S. Cl.
USPC ..... 273/153 S; 273/153 R; 463/7; 463/9

(58) Field of Classification Search
USPC ..... 463/7, 35, 46, 9; 273/153 R, 153 S
See application file for complete search history.

(56) References Cited

U.S. PATENT DOCUMENTS

| | | | | |
|---|---|---|---|---|
| 4,124,881 | A | 11/1978 | Haber | |
| 4,575,087 | A | 3/1986 | Sinclair | |
| 6,994,555 | B2 * | 2/2006 | Weiner et al. | 434/236 |
| 7,371,177 | B2 * | 5/2008 | Ellis et al. | 463/42 |
| 2003/0148700 | A1 * | 8/2003 | Arlinsky et al. | 446/91 |
| 2004/0106091 | A1 * | 6/2004 | Weiner et al. | 434/236 |
| 2008/0237981 | A1 * | 10/2008 | Gilles et al. | 273/153 S |

FOREIGN PATENT DOCUMENTS

| | | | |
|---|---|---|---|
| CN | 200954393 | Y | 10/2007 |
| CN | 101291711 | A | 10/2008 |

OTHER PUBLICATIONS

Notification of Transmittal of the International Search Report and the Written Opinion of the International Searching Authority, Jul. 28, 2011.

* cited by examiner

*Primary Examiner* — Dmitry Suhol
*Assistant Examiner* — Alex F. R. P Rada, II
(74) *Attorney, Agent, or Firm* — Ren-Sheng International

(57) ABSTRACT

A three-dimensional puzzle cube is generally described. The three-dimensional puzzle cube may include multiple blocks that are interconnected and movable, an output device, and a control unit that generates a control signal to the output device when the control unit determines that the blocks are arranged in a predetermined configuration.

13 Claims, 3 Drawing Sheets

AUDIBLE PUZZLE CUBE

CROSS-REFERENCE TO RELATED APPLICATIONS

The present application is a 371 application of International Application PCT/CN2010/078182, filed on Oct. 28, 2010 and entitled "AUDIBLE PUZZLE CUBE." The International Application, including any appendices or attachments thereof, is incorporated by reference herein in its entirety.

BACKGROUND

Unless otherwise indicated herein, the approaches described in this section are not prior art to the claims in this application and are not admitted to be prior art by inclusion in this section.

The Rubik's Cube®, a three-dimensional mechanical puzzle cube, quickly gained popularity worldwide since its introduction by a professor of architecture, Erno Rubik. The "magic cube," as it was originally called, has become one of the world's top selling toys. It is, however, difficult to solve, and many players lose interest after just minutes of playing with it.

SUMMARY

In accordance with one embodiment of the disclosure, a three-dimensional puzzle cube includes multiple blocks that are interconnected and movable, an output device, and a control unit. The control unit may generate a control signal to the output device when the control unit determines that the blocks are arranged in a predetermined configuration.

In accordance with another embodiment of the disclosure, an apparatus includes a puzzle cube having interconnected and movable blocks, an output device, and a control unit that is electrically connected to the blocks. The control unit may determine relative positioning of the blocks, and that issues a control signal to the output device when the blocks are arranged in a predetermined configuration.

In accordance with a further embodiment of the disclosure, an apparatus includes a puzzle cube having 26 interconnected and movable blocks arranged on six sides of the puzzle cube, such that a 3×3 grid of 9 blocks are arranged on each of the six sides, a speaker installed in a center block of the 3×3 grid of 9 blocks arranged on a first one of the six sides, a microphone installed in a center block of the 3×3 grid of 9 blocks arranged on a second one of the six sides, a storage unit that stores audio received through the microphone, and a control unit that is electrically connected to the blocks. The control unit may determine relative positioning of the blocks, and that controls the speaker to play back an audio clip stored in the storage unit when the blocks are arranged in a predetermined configuration.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
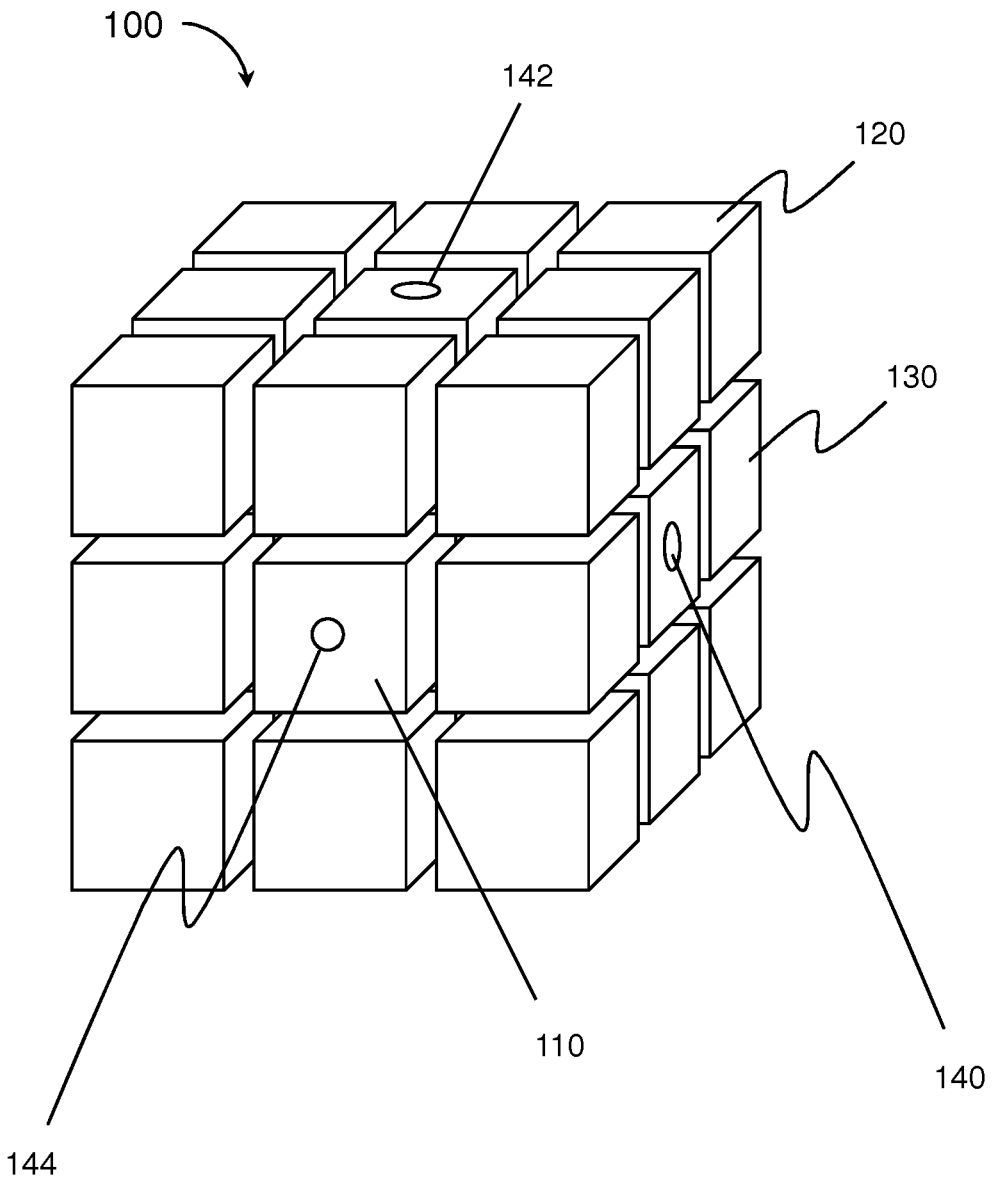
FIG. 1 is a perspective view of an audible puzzle cube according to an embodiment of this disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

This disclosure is drawn, inter alia, to a three-dimensional puzzle configured with elements designed to maintain a player's interest in the puzzle.

According to one embodiment of this disclosure, the thee-dimensional puzzle includes multiple blocks that are interconnected and movable, an output device, and a control unit that issues a control signal to the output device when the control unit determines that the blocks are arranged in a predetermined configuration. The output device may be a speaker that outputs recorded audio when the control signal is received from the control unit and/or a vibrating unit that vibrates when the control signal is received from the control unit. A microphone may be provided in one of the blocks so that the audio that the speaker plays back is audio that was or is recorded through the microphone.

According to another embodiment of this disclosure, the thee-dimensional puzzle includes a puzzle cube having interconnected and movable blocks, an output device, and a control unit that is electrically connected to the blocks, and that determines relative positioning of the blocks and issues a control signal to the output device when the blocks are arranged in a predetermined configuration. The output device may be a speaker that outputs a recorded audio when the control signal is received from the control unit and/or a vibrating unit that vibrates when the control signal is received from the control unit. A microphone may be provided in one of the blocks so that the audio that the speaker plays back is audio recorded through the microphone.

According to still another embodiment of this disclosure, the thee-dimensional puzzle includes a puzzle cube having 26 interconnected and movable blocks arranged on six sides of the puzzle cube, such that a 3×3 grid of 9 blocks are arranged on each of the six sides, a speaker installed in a center block of the 3×3 grid of 9 blocks arranged on a first one of the six sides, a microphone installed in a center block of the 3×3 grid of 9 blocks arranged on a second one of the six sides, a storage unit that stores audio received through the microphone, and a control unit that is electrically connected to the blocks, and that determines relative positioning of the blocks and controls the speaker to play back an audio clip stored in the storage unit when the blocks are arranged in a predetermined configuration.

FIG. 1 is a perspective view of an audible puzzle cube 100 according to an embodiment of this disclosure. Puzzle cube 100 has 26 blocks that are interconnected for relative movement with respect to each other. Blocks of puzzle cube 100 include six center blocks 110, eight corner blocks 120, and twelve mid-face blocks 130. Center blocks 110 each have one exposed face. Corner blocks 120 each have three exposed faces. Mid-face blocks 130 each have two exposed faces.

Groups of nine blocks each define a plate that is rotatable about one of the three spatial axes of puzzle cube 100. When puzzle cube 100 is in its starting, undisturbed condition, all of the faces on a given side are the same color, and each side of the cube is of a different color. The object of the game is to disturb the original pattern, and then sequentially rotate the plates so as to restore all of the blocks to its original configuration and thus restore each of the six sides of puzzle cube 100 to its original color.

In accordance with one or more embodiments of this disclosure, puzzle cube 100 includes an ON/OFF button 140, a speaker 142, and a microphone 144. When power is turned ON through operation of ON/OFF button 140, the audible or feedback features of puzzle cube 100 are enabled. The audible features include the capability to record audio, such as audio clips, audio streams, audio signals, sounds, etc., through microphone 144 and playing back various recorded audio, including the some or all of the audio recorded through microphone 144, through speaker 142 as puzzle cube 100 is manipulated. The feedback features include playing back (i.e., reproducing) particular audio clips through speaker 142 and/or activating the vibration module installed within puzzle cube 100, if a user who is manipulating puzzle cube 100 is on the "right track" to restoring puzzle cube 100 to its original configuration. The feedback may be provided at certain milestones on the way to restoring puzzle cube 100 to its original configuration. In some embodiments, the feedback may be positive or negative. For example, the user may be given positive feedback for reaching certain milestones, such as one side completed or two sides completed, and negative feedback for moving away from any of the milestones after having achieved the milestone. Examples of positive feedback include longer audio clips, a higher volume, and various pleasant tones. Examples of negative feedback include shorter audio clips, a lower volume, and various unpleasant tones. Example methods for detecting whether a user has achieved certain milestones on the way to restoring puzzle cube 100 to its original configuration are described in further detail below.

Figure 2:
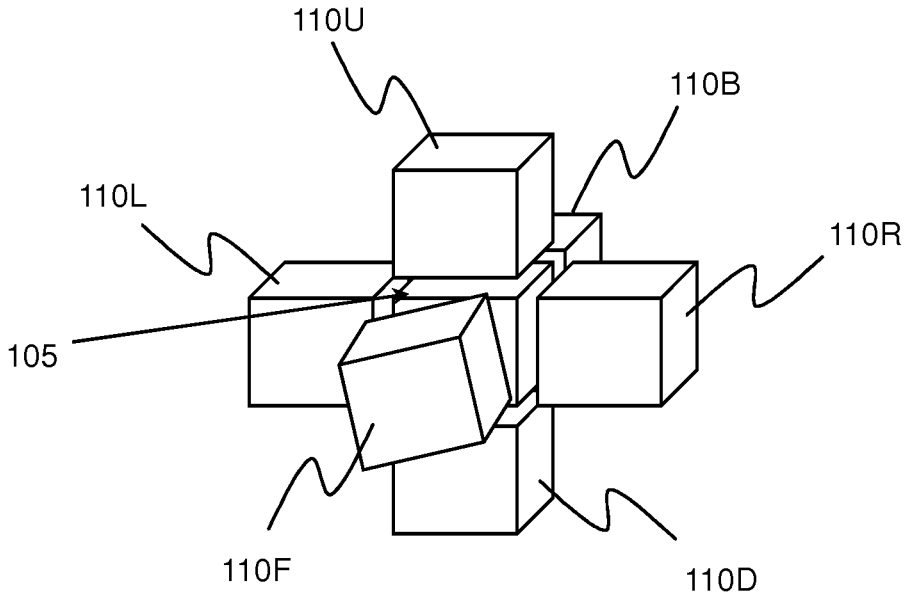
FIG. 2 shows the center blocks of the puzzle cube of FIG. 1.

FIG. 2 shows the center blocks of the puzzle cube of FIG. 1. Center blocks 110 include a left center block 110L, a right center block 110R, a front center block 110F, a back center block 1108, an upper center block 110U, and a lower center block 110D. Each of center blocks 110 is connected to a core block 105 so that each center block 110 can rotate with respect to core block 105, as shown in FIG. 2 for center block 110F. Corner blocks 120 and mid-face blocks 130 each have connection elements that allow them to be assembled to center blocks 110 and to be rotated with respect to core block 105 along with the center block to which they are connected.

Figure 3:
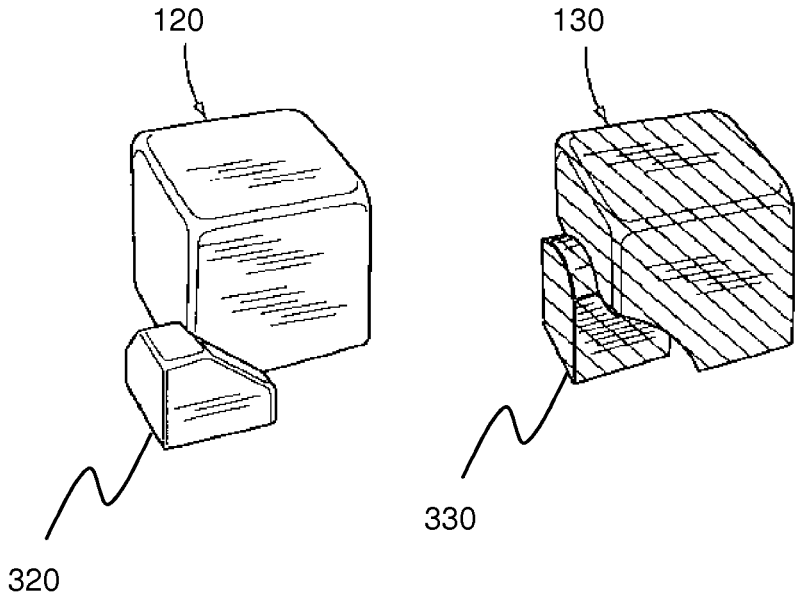
FIG. 3 illustrates corner and mid-face blocks that have been disassembled from the puzzle cube of FIG. 1.

FIG. 3 illustrates corner and mid-face blocks that have been disassembled from the puzzle cube of FIG. 1. Each corner block 120 has a connection element 320 that extends from a corner that is furthest from its three exposed surfaces. Each mid-face block 130 has a connection element 330 that extends from an edge that is furthest from its two exposed surfaces.

In one embodiment of the present disclosure, each of center blocks 110 is configured to generate a voltage signal when puzzle cube 100 is powered ON, and each of corner blocks 120 and mid-face blocks 130 is configured with a feedback circuit that forms a closed electric circuit with a corresponding center block 110, only when it is in a correct position relative to the corresponding center block 110. This conditional closed electric circuit may be achieved by forming first conductive portions on center blocks 110, and corresponding second conductive portions on connection elements 320 and 330 of corner blocks 120 and mid-face blocks 130, respectively, such that the first and second conductive portions are aligned to permit passage of voltage signals only when the corner block 120 or the mid-face block 130 is in the correct position relative to the center block 110. It should be recognized that other ways of achieving the conditional closed electric circuit are within the scope of this present disclosure. In addition, it should be recognized that other ways of detecting whether a user has completed one or more sides are within the scope of this present disclosure.

Figure 4:
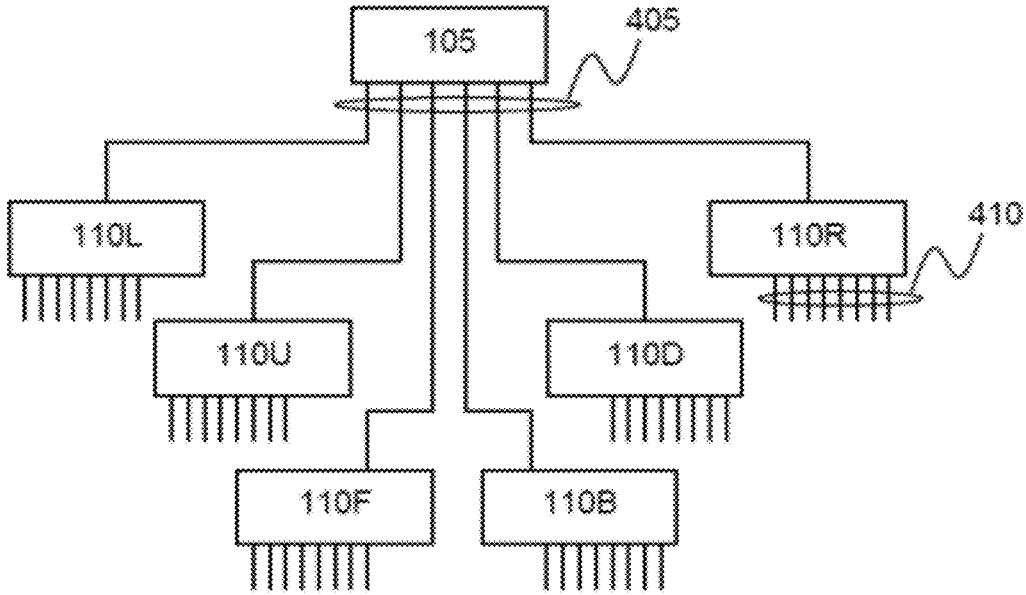
FIG. 4 is a schematic diagram of an illustrative embodiment of signal paths from individual blocks to a core block in the puzzle cube of FIG. 1.

FIG. 4 is a schematic diagram of an illustrative embodiment of signal paths from individual blocks to a core block in the puzzle cube of FIG. 1. The signal paths from individual blocks first traverse center blocks 110 through electrical interfaces 410 (i.e., first and second conductive portions described above). It should be understood that a signal path from an individual block contains a voltage signal only when the individual block is in the correct position relative to its corresponding center block. Thus, when a side of puzzle cube 100 is completed, voltage signals appear in all of the signal paths from the individual blocks of the completed side. Each of center blocks 110 passes the voltage signals that it receives from the individual blocks to core block 105 through electrical interface 405 so that a determination can be made by a control unit 510 of puzzle cube 100 (shown in FIG. 5) whether a user has achieved certain milestones on the way to restoring puzzle cube 100 to its original configuration.

Figure 5:
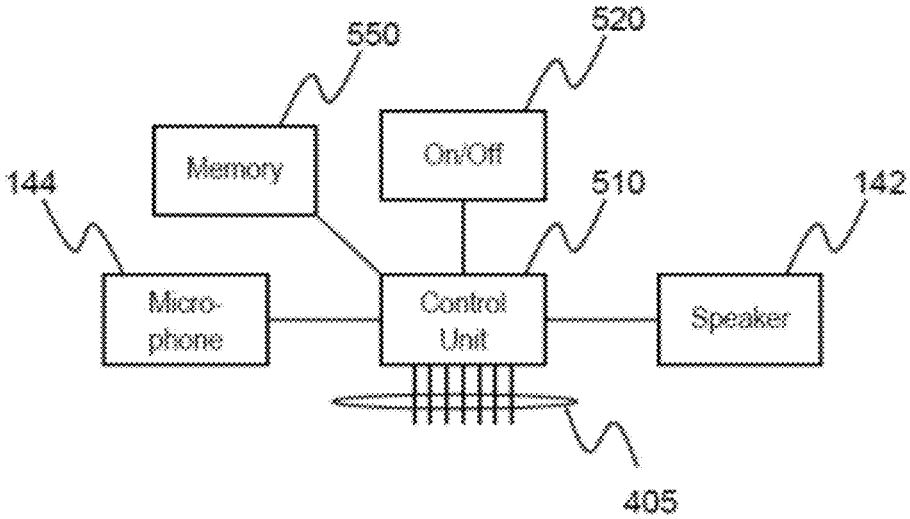
FIG. 5 is a block diagram of an illustrative embodiment of representative electronic modules of the puzzle cube of FIG. 1.

FIG. 5 is a block diagram of an illustrative embodiment of representative modules of the puzzle cube of FIG. 1. As depicted, the electronic modules of puzzle cube 100 include a control unit 510, an ON-OFF module 520, speaker 142, microphone 144, and a memory unit 550. In one example implementation, control unit 510 may be mounted (or installed) in core block 105. Control unit 510 may be powered ON and OFF through ON-OFF button 140 that is electrically coupled to ON-OFF module 520. For example, operation of the ON-OFF button causes ON-OFF module 520 to alternately turn power control unit 510 ON and OFF. Control unit 510 may control playback of one or more audio clips stored in memory unit 550 or may control the operation of a vibration module (not shown). By way of example, control unit 510 may cause an audio clip or a portion of an audio clip stored in memory unit 550 to be played back (or reproduced) through speaker 142. By way of another example, control unit 510 may cause the vibration module to vibrate for a predetermined period of time. Audio, such as audio clips, audio streams, audio signals, sounds, etc., stored in memory unit 550 may be pre-recorded audio or audio recorded through microphone 144. The selection of the audio played back through speaker 142, and the conditions under which such audio is played back or the conditions under which vibration module is activated or turned on are programmable features of control unit 510. In addition, when power control unit 510 is turned ON, power is supplied to each of center blocks 110 so that the voltage signal used in determining whether closed electric circuits are established with surrounding blocks can be generated.

In one embodiment of the present disclosure, control unit 510 includes a ATmega16 programmable single-chip processor from Atmel and the ISD1810 audio peripheral chip from ISD, and microphone 144 is an MSMAS42z MEMS microphone available from MingXin. Audio collected through microphone 144 is processed and stored as one or more clips that are played back through speaker 142. As puzzle cube 100 is rotated and achieves predetermined configurations, e.g., when all of the blocks surrounding one or more of the center blocks 110 are in their correct positions, a recorded audio clip is played back as a reward. It should be recognized that control unit 510 is able to determine whether one or more sides of puzzle cube 100 are completed by evaluating the voltage signals that it receives from center blocks 110 through electrical interface 405. For example, if eight voltage signals are received through electrical interface 405 from one center block, one side is completed; if eight voltage signals are received through electrical interface 405 from two center blocks, two side are completed; and so forth. In addition, a vibration module (not shown) may be activated to give a tactile feedback to the user as a reward for moving puzzle cube 100 towards its original configuration. In some embodiments, negative feedback is given in the form of shorter audio clips, a lower volume, and various unpleasant tones, when the puzzle cube 100 is moved out of one of the predetermined configurations that had been attained. When puzzle cube 100 is restored to its original configuration, the entire recorded audio is played back.

There is little distinction left between hardware and software implementations of aspects of systems; the use of hardware or software is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application.

The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed:

1. An apparatus, comprising:

a three-dimensional puzzle comprising:

a core block; and interconnected blocks arranged on faces of the puzzle, each face comprising a center block coupled to the core block so each face is rotatable in one of three spatial axes of the puzzle;

an audio output device in a first center block, the audio output device being configured to output audio;

a microphone in a second center block, the microphone being configured to receive audio;

a storage unit in the core block, the storage unit being configured to store the received audio as an audio clip; and a control unit in the core block, the control unit being electrically connected to the blocks, the control unit being configured to automatically determine relative positioning of the interconnected blocks and cause the audio output device to output the audio clip when the interconnected blocks are arranged in a predetermined configuration.

2. The apparatus according to claim 1, wherein the interconnected blocks are electrically and mechanically interconnected.

3. The apparatus according to claim 1, wherein the predetermined configuration of the interconnected blocks corresponds to an original configuration of the interconnected blocks.

4. The apparatus according to claim 1, wherein the predetermined configuration of the interconnected blocks does not correspond to an original configuration of the interconnected blocks.

5. The apparatus according to claim 1, further comprising a vibrational output device being configured to vibrate, wherein the control unit is further configured to automatically cause the vibrational output device to vibrate when the interconnected blocks are arranged in the predetermined configuration.

6. The apparatus according to claim 1, wherein the puzzle is a cube having 26 interconnected blocks arranged on six sides of the cube such that a 3×3 grid of 9 interconnected blocks are arranged on each of the six sides.

7. The apparatus according to claim 1, wherein each face includes outer blocks and each outer block includes a feedback circuit that forms a closed electric circuit with a respective center block when the outer block is in a correct position relative to the respective center block.

8. An apparatus comprising:

a puzzle cube having 26 interconnected and movable blocks arranged on six sides of the puzzle cube, such that a 3×3 grid of 9 blocks are arranged on each of the six sides;

an audio output device installed in a center block of the 3×3 grid of 9 blocks arranged on a first one of the six sides;

a microphone coupled to a center block of the 3×3 grid of 9 blocks arranged on a second one of the six sides, wherein the microphone is configured to receive audio;

a storage unit that is configured to store the received audio as an audio clip; and a control unit electrically connected to the interconnected and movable blocks, the control unit being configured to determine relative positioning of the interconnected and movable blocks and automatically cause the audio output device to output the audio clip when the interconnected and movable blocks are arranged in a predetermined configuration.

9. The apparatus according to claim 8, further comprising a vibrational output device configured to vibrate under control of the control unit.

10. The apparatus according to claim 8, wherein the interconnected and movable blocks in each 3×3 grid of 9 blocks include a center block and outer blocks, and each outer block includes a feedback circuit that forms a closed electric circuit with the center block when the outer block is in a correct position relative to the center block.

11. The apparatus according to claim 8, wherein the predetermined configuration of the interconnected and movable blocks corresponds to the original configuration of the interconnected and movable blocks and the audio clip is an entire portion of the audio received with the microphone.

12. The apparatus according to claim 8, wherein the predetermined configuration of the interconnected and movable blocks does not correspond to the original configuration of the interconnected and movable blocks and the audio clip is a portion of the audio received with the microphone.

13. The apparatus according to claim 12, wherein the control unit controls the audio output device to play back an entire portion of the audio received through the microphone when the interconnected and movable blocks are restored to their original configuration.

* * * * *

UNITED STATES PATENT AND TRADEMARK OFFICE

CERTIFICATE OF CORRECTION

PATENT NO. : 8,465,020 B2
APPLICATION NO. : 13/263841
DATED : June 18, 2013
INVENTOR(S) : Dai et al.

It is certified that error appears in the above-identified patent and that said Letters Patent is hereby corrected as shown below:

In the Specification

Column 1, Line 22, delete "Erno" and insert -- Ernö --, therefor.

Column 3, Line 54, delete "1108," and insert -- 110B, --, therefor.

Column 6, Line 2, delete "and or" and insert -- and/or --, therefor.

Signed and Sealed this
Eighth Day of October, 2013

Teresa Stanek Rea

Teresa Stanek Rea
*Deputy Director of the United States Patent and Trademark Office*